US005169026A

United States Patent [19]

Patterson

[11] Patent Number: 5,169,026

[45] Date of Patent: Dec. 8, 1992

[54] HOLDER FOR LIQUID CONTAINING PACKAGE

[75] Inventor: Keith D. Patterson, Providence, R.I.

[73] Assignee: Little Kids, Inc., Providence, R.I.

[21] Appl. No.: 858,221

[22] Filed: Mar. 26, 1992

Related U.S. Application Data

[60] Division of Ser. No. 655,212, Feb. 12, 1991, Pat. No. 5,105,976, which is a continuation of Ser. No. 419,492, Oct. 10, 1989, abandoned.

[51] Int. Cl.[5] ..... B65D 17/44

[52] U.S. Cl. ..... 220/740; 220/711; 220/713; 220/703; 220/719; 222/88

[58] Field of Search ..... 222/83, 83.5, 88; 220/711, 713, 703, 719, 740

[56] References Cited

U.S. PATENT DOCUMENTS

| | | | |
|---|---|---|---|
| 1,411,542 | 4/1922 | Van Orsdale | 222/88 |
| 1,514,225 | 11/1924 | Phillips | 222/83.5 |
| 1,912,283 | 5/1933 | Kronquest | 222/88 |
| 2,270,396 | 1/1942 | Van Woert, Sr. et al. | 222/88 |
| 3,160,322 | 12/1964 | Burnett | 222/88 |
| 4,050,611 | 9/1977 | Frantz | 222/88 |
| 4,148,418 | 4/1979 | Ewing et al. | 220/740 |
| 4,437,575 | 3/1984 | Hahn | 220/740 |
| 4,561,660 | 12/1985 | Lyon | 220/740 |
| 4,629,183 | 12/1986 | Marcum | 220/740 |
| 4,693,440 | 9/1987 | Lalonde | 220/740 |
| 4,723,689 | 2/1988 | Vallos et al. | 220/740 |
| 4,749,162 | 6/1988 | Wanzor . | |
| 4,813,558 | 3/1989 | Fujiyosh | 220/740 |
| 4,986,435 | 1/1991 | Wright | 220/740 |

*Primary Examiner*—Joseph Man-Fu Moy
*Attorney, Agent, or Firm*—Salter, Michaelson & Benson

[57] ABSTRACT

A holder for a liquid containing package such as an aseptic juice package including a housing that receives the aseptic juice package in secure relation therein, the housing having an internal projection fixed therein that is received in an opening as formed in the juice package when the package is inserted into the housing, the projection having a passage formed therein that communicates with a feed member that is mounted on the housing, the liquid in the package being directed through the passage in the projection and outwardly of the feed member through a feed passage as formed therein when the holder is tipped by the user during the use thereof.

2 Claims, 2 Drawing Sheets

HOLDER FOR LIQUID CONTAINING PACKAGE

BACKGROUND OF THE INVENTION

This is a division of U.S. application Ser. No. 07/655,212 filed Feb. 12, 1991 now U.S. Pat. No. 5,105,976 which is a continuation of U.S. application Ser. No. 07/419,492 filed Oct. 10, 1989, now abandoned.

The present invention relates to a holder for a liquid containing package and provides for receiving the package therein for conveniently directing the liquid contents of the package into a feed member when the holder is tipped during the use thereof.

Aseptic juice packages have been developed in recent years as an inexpensive package for juice consumption by children and have been referred to as "paper" bottles. The aseptic juice package normally has a straw packaged therewith which is insertable through a membrane that covers an opening as formed in the top wall of the package. The straw is then utilized by the user to withdraw the liquid contents of the package. The package is usually made of flexible disposable materials, and therefore when the contents of the package are consumed, it may be disposed of in any convenient way along with other paper waste products.

One of the inconveniences associated with aseptic juice packages that incorporate straws for withdrawing the contents thereof, is the frequent spilling of the contents, particularly when the package is in the hands of a young child as a user. Further, young children tend to remove the straw from its opening in the package before the contents thereof are fully consumed, and as a result the remaining liquid in the package is oftentimes spilled. Spillage of the liquid from an aseptic juice packages is more likely to occur when the package is used by a young child in a moving vehicle, and in this instance, spilling of the package contents not only usually results in the child and its clothing becoming soiled, but the vehicle upholstery and floor are also soiled. Further, aseptic juice packages are not easily handled by small children because of their configuration and when such children attempt to withdraw the liquid from the package in a moving vehicle, often times the package is dropped resulting in the soiling of vehicle upholstery and floor.

Because aseptic juice packages are formed of flexible materials, the walls thereof are easily deformable. As a result, children will oftentime squeeze the package which results in the contents thereof being rapidly expelled outwardly of the package, thereby causing the surrounding areas to be saturated with the package liquid. Obviously, such use of the prior known juice packages is difficult to prevent when small children are involved, and as a result parents are apt to avoid purchasing the package.

Some efforts have been made to avoid the problems in the use of aseptic juice packages as recited hereinabove, and one such attempted solution is illustrated in the U.S. Pat. No. to Rule, 4,801,007, which discloses a teat unit, wherein a feeding nipple or the like is inserted into a juice package. However, this construction does not solve the problem of a young child mishandling the package as used with a straw, and is evidently useful only for very small children or babies that are still using a nippled bottle.

Another example of a device for dispensing liquid from a paper container is illustrated by the pivotable spout disclosed in the U.S. Pat. No. to Mitchell 4,771,916. The Mitchell patent discloses a dispenser spout as pivotably mounted on an assembly that is used in connection with a so called "paper" bottle. However, the construction in the Mitchell patent is relatively complex and does not provide for a suitable means for a child user for holding the container for properly feeding the liquid through the spout.

Applicant is also aware of a product that is presently being merchandised for holding aseptic juice packages therein, but the unique feature of this construction is the pivotal opening of the holder body for receiving the package therein. A straw is still utilized with this construction which does not cure the problem of spilling of the contents of the container as presently being experienced with the aseptic juice packages now in use.

Other prior art of which the applicant is aware and that relates generally to the subject invention are the U.S. Pat. Nos. to Knabel 2,746,645, Charlton 2,786,271, Gaines 3,538,866, and Schmit 3,938,707.

As will be described, the subject invention provides for a holder for liquid containing packages that is simple in construction and that provides for the feeding of the liquid contents in the package to a feed member with which a small child is accustomed. The holder also insures that the package may be easily tipped in use for promoting a proper feeding action and further prevents spilling of the liquid from the package.

SUMMARY OF THE INVENTION

The present invention relates to a holder for a liquid containing package, wherein the package is formed with a top wall in which a hole covered by a flexible membrane is formed. The holder comprises a housing including front and rear walls to which opposed sidewalls and a top wall are joined, said walls defining an interior cavity. Each of the sidewalls is formed with a longitudinally extending slot therein that provides for deflecting movement of the front and rear walls, wherein a package having a configuration corresponding to that of the interior cavity of the housing is receivable within the housing and is retained therein in positive locked position.

Formed on the underside of the top wall of the housing for penetrating the membrane on the package when the package is inserted into the housing, is a projection that extends into the hole in the package. A neck section is joined to the top wall and receives a liquid feed member thereon, the neck section having an opening formed therein that is aligned with the hole in the package. The feed member includes a feed passage that communicate with the opening as formed in the neck section and the hole as formed in the package, wherein the liquid in the package is fed into the feed member for consumption by user when the housing with the package fixed therein is tipped upwardly by the user. The protection as forced into the package hole when the package is inserted into the holder also acts to seal the hole thereby preventing liquid in the package from leaking into the holder when the holder with the package secured therein is tipped during use.

The present invention also avoids the prior known problem of squeezing the juice package to cause spillage by forming the housing walls of a relatively rigid although somewhat deformable material and by providing convenient handles for grasping by a child. The handles enable a user to use the holder without handling the housing and thereby avoids the possibility of squeezing of the package walls by the user to expel the liquid therefrom.

Accordingly, it is an object of the present invention to provide a holder for a liquid containing package that enables the package to be inserted within a housing of the holder for establishing direct communication of the contents of the package with a feed member that is mounted on the housing, so that a user of the holder can conveniently handle the holder and tip it so that the liquid in the package is easily fed from the package into a feed member for consumption by the user.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
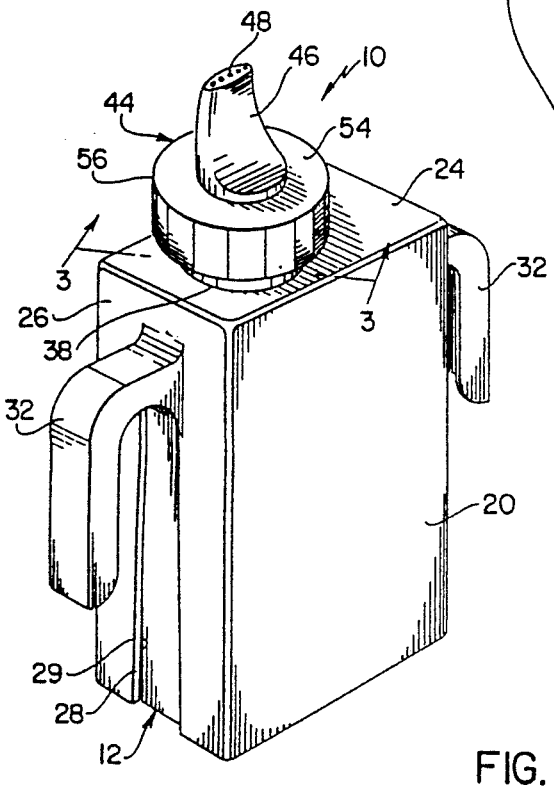
FIG. 1 is a perspective view of a holder for a liquid containing package as embodied in the subject invention.
Figure 2:
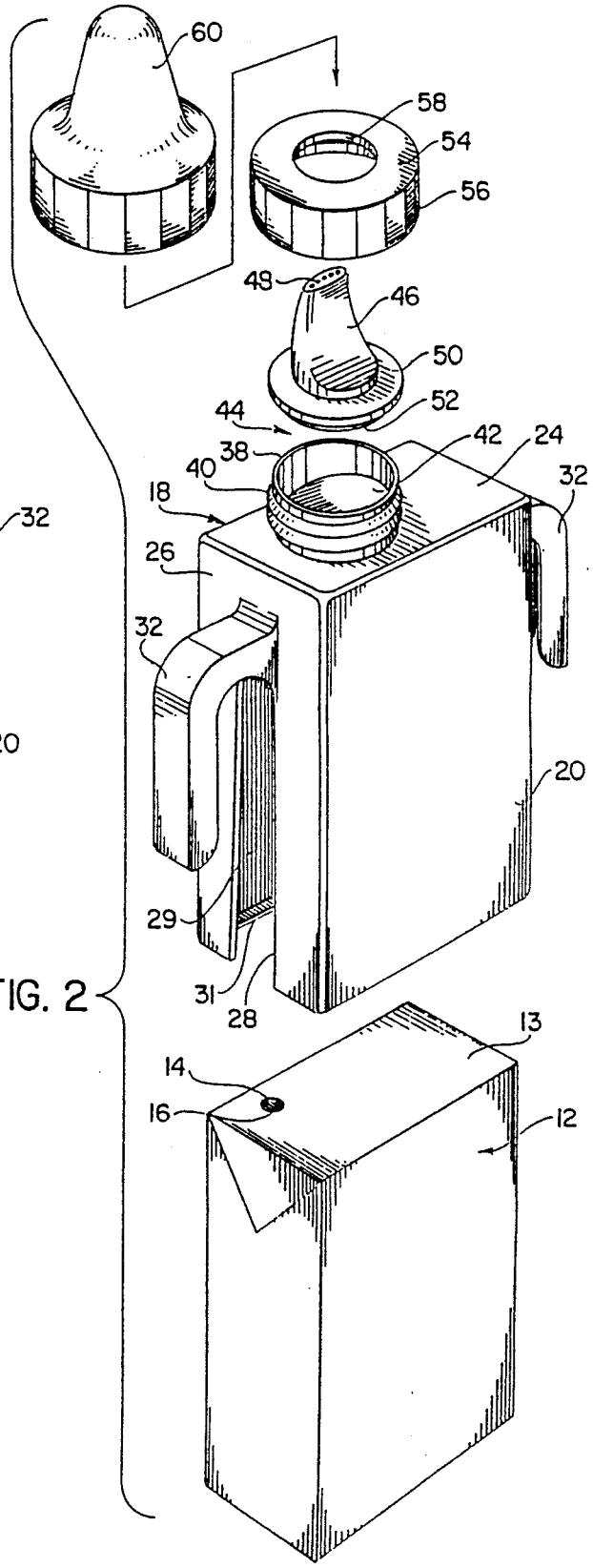
FIG. 2 is an exploded perspective view of the holder illustrated in FIG. 1 and the package that is received therein.

Referring now to the drawings and particularly to FIGS. 1 and 2, the holder as embodied in the subject invention is illustrated and is generally indicated at 10. As will be described, the holder 10 is designed specifically to accommodate an aseptic juice package therein of the type that is presently being marketed for sale to the trade. An example of such an aseptic juice package is illustrated in FIG. 2 and is indicated at 12, and as shown in FIG. 2 the package 12 is formed in an oblong configuration of a coated paper material that is folded so as to include a top wall 13 having an opening 14 formed therein, that is covered by a membrane 16. The holder 10 includes a housing generally indicated at 18 that is molded of any conventional plastic material in an oblong configuration and, as will be described, the housing 18 receives the juice package 12 therein in snug fitting relation. The opening 14 as formed in the top wall 13 of the package 12 is located such that it is spaced from the longitudinal axis thereof adjacent to a corner of the top wall 13 and normally receives a straw that accompanies the package 12 when sold. As will also be described, when the package 12 is inserted into the housing 18 the opening 14 communicates with an interior projection in the housing 18 which provides for the feeding of the liquid as contained in the package 12 to a feeding device that is mounted on the top of the housing 18.

The housing 18 of the holder 10 is formed with a front wall 20, a rear wall 22, a top wall 24, and sidewalls 26. Formed in the sidewalls 26 are longitudinally extending slots 28 that provide for deflection of the front and rear walls 20 and 22 when the package 12 is inserted interiorally of the housing. It is seen that the front and rear walls, top wall, and sidewalls define a cavity 29 therein that has a configuration that is generally oblong in shape for accommodating the correspondingly oblong shaped package 12.

Figure 5:
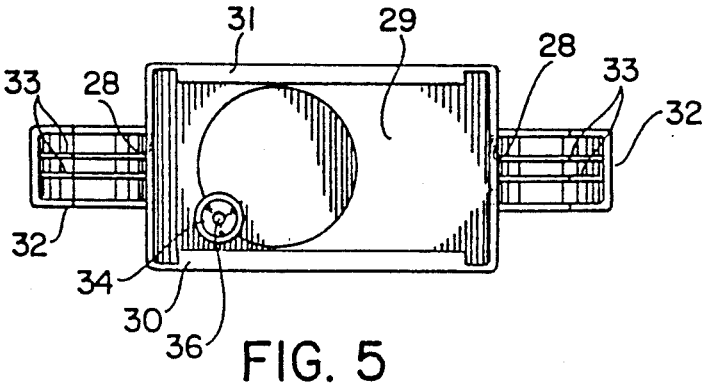
FIG. 5 is a bottom plan view thereof.

Joined to the lowermost edges of the front wall 20 and the rear wall 22 are flanges 30 and 31, respectively (FIG. 5), that are designed to receive thereon the lowermost edges of the bottom wall of the package 12 for securing the package in position within the cavity 29 as formed in the housing 18. In order to provide a convenient means for handling the holder 10, hollow-like handles 32 are integrally joined to the sidewalls 26 just above the slots 28 and depend downwardly in spaced parallel relation with respect to the sidewalls 26 and the slots 28 as formed therein. In order to prevent undue deflection of the handles 32 in use, interior strengthening ribs 33 are provided and extend longitudinally of the handles for the length thereof. It is apparent that the handles 32 enable a child to conveniently manipulate the holder in the use thereof.

Figure 3:
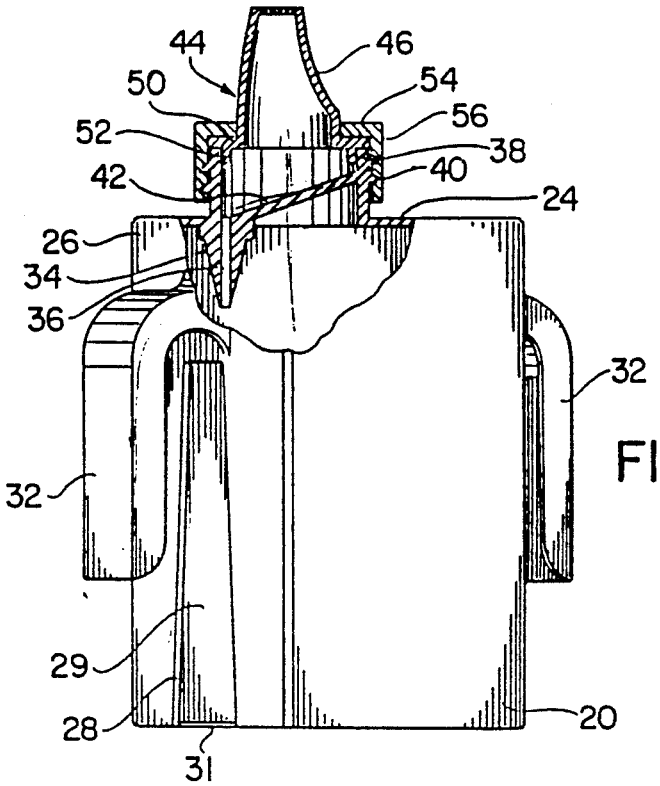
FIG. 3 is a perspective view of the holder without the package contained therein, a portion of the holder and the neck section thereof being shown in section taken along lines 3—3 in FIG. 1.
Figure 4:
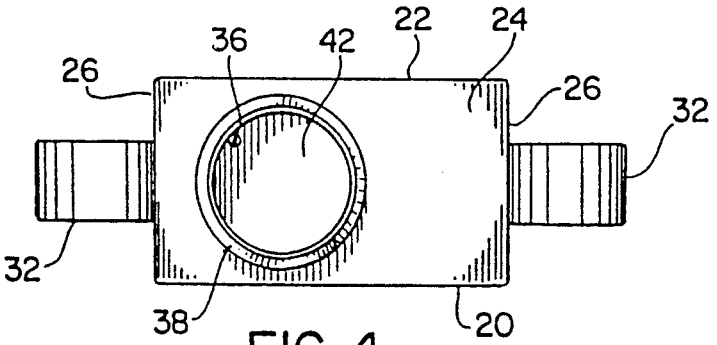
FIG. 4 is a top plan view of the package.

Referring particularly to FIG. 3, the upper interior portion of the housing 18 is illustrated and as shown includes a downwardly extending projection 34 that is joined to the underside of the top wall 24. The projection 34 has a downwardly decreasing, tapered configuration and is formed with an interior bore or passage 36. The diameter of the lowermost end of the projection 34 is sufficiently small enough to be received within the opening 14 of the package 12 when the package is inserted into the housing 18. It is also seen that the location of the projection 34 is such that the projection 34 is aligned with the opening 14 when the package 12 is inserted into the housing 18. Since the lowermost end of the projection 34 is reduced in diameter, it acts to break the seal of the membrane 16 on the package 12 as the package is forced into the cavity 29 of the housing 18, the projection 34 being forced inwardly of the package 12 to provide for communication of the passage 36 with the interior of the package.

It is further seen that the tapered configuration of the projection 34 acts to seal the edges of the opening 14 in the package 12 when the package is inserted into the cavity 29 of the housing 18. Thus, as the tapered projection is force fitted into the opening 14, a tight seal is formed around the opening that prevents liquid in the package from leaking around the edges of the opening and into the cavity 29 of the housing 18 when the holder 10 is tipped during use.

As further shown in FIG. 3, an annular neck section 38 is formed on the uppermost end of the housing 18 and is formed integral with the top wall 24. As will be seen, the neck section 38 is axially offset inwardly relative to the projection 34 in a direction toward a central position on the top wall 24 so that the entire perimeter of the neck section 38 is disposed within the confines of the perimeter of the top wall 24. The neck section 38 has exterior threads 40 formed thereon and also includes an interior wall 42 that is inclined such that the lowermost portion thereof is disposed adjacent to the passage 36 that extends through the top wall 24. Thus, the uppermost end of the passage 36 has communication within the neck section 38 and as will be described, the inclined wall 42 directs any liquid that is retained in the neck section after the use of the device into the passage 36 for draining back into the package 12.

In order to provide a convenient means for drinking the liquid contents of the package 12, a feeding member generally indicated at 44 is utilized. The feeding member 44 is aligned with the neck section 38, and therefore the feeding member 44 is also axially offset relative to the projection 34 in a direction toward a central position on the top wall 24. The feeding member 44 includes a drinking spout 46 that is formed in a configuration that is generally similar to a conventional trainer drinking spout and has a feed passage formed interiorly thereof that communicates with a plurality of openings 48 formed in the uppermost end thereof. Joined to the drinking spout 46 is an annular flange 50 on which an annular reduced depending skirt 52 is formed. As shown in FIG. 3, the skirt 52 is received within the neck section 38 in frictional relation, the flange 50 resting on the uppermost edge of the neck section 38 and extending slightly therebeyond. In order to retain the drinking spout 46 in place, the feeding member 44 further includes a retaining element 54 to which a depending skirt 56 is joined, the skirt 56 having interior threads that are engageable with the corresponding threads 40 as formed on the exterior surface of the neck section 38. Formed in the retaining element 54 is an opening 58, the diameter of which is dimensioned to receive the drinking spout 46 therein so that the portion of the drinking spout 46 that is adjacent to the flange 50 is slightly less than the diameter of the opening 58 thereby providing for entry of the drinking spout through the opening 58. A cover cap 60 is also provided and may be fitted over the drinking spout 46 for engagement with the skirt 56 to provide protection for the drinking spout in the conventional manner, and is normally used for travelling purposes.

In use of the holder 10 the cap 60 is removed from the top of the feeding member 44. An aseptic juice package 12 is then inserted into the cavity 29 as formed within the housing 18 of the holder 10. In the insertion of the package 12 into the housing 18, the membrane covered opening 14 is aligned with the projection 34 located interiorly of the housing 18. Although not illustrated a guide arrow is molded into the outer face of the rear wall 22 and indicates the direction of the insertion of the package with respect to location of the membrane covered hole 14. Thus, the guide arrow indicates that the package 12 is inserted into the housing 18 as shown in FIG. 2 wherein the hole 14 is aligned with the projection 34. As the package is moved within the cavity 29 of the housing 18, the lowermost end of the projection 34 engages the membrane 16, breaks the seal, and enters the opening 14. When the package is seated in its inner most position, the lowermost edge thereof is received behind the flanges 30 and 31 for locating the package within the housing cavity in fixed position. The walls 20 and 22 of the housing are deflected slightly as the package enters the cavity 29, the deflecting walls permitting the package to slide easily within the cavity 29 until it is firmly seated therein. The walls 20 and 22 can then be released and cooperate with the flanges 30 and 31 to hold the package in place. As the package 12 is forced into the cavity 29 of the housing 18, the tapered configuration of the projection 34, produces an effective seal around the package opening 14 that prevents leakage of the liquid therearound when the package is tipped during use.

The holder is now ready for use by a child user who grasps the handles 32 for manipulation so that the drinking spout 46 is conveniently inserted within the user's mouth. As the user tips the holder upwardly in a drinking motion, the liquid contents within the package 12 enter through the passage 36 of the projection 34 and interiorly of the neck section 38. With the holder still in the tipped position, the liquid contents as directed into the neck section 34 are then received within the drinking spout 46 and flow through the openings 48 at the end of the spout for consumption by the user. Since the user will tend to effect a sucking action on the drinking spout during use, the resulting suction produces an even flow of the liquid from the package through the drinking spout. When the holder is moved to the normal upright position, any liquid remaining in the drinking spout 46 and neck section 38 drains downwardly onto the inclined wall 42 into the passage 36 and then back into the interior of the package 12. When the liquid contents in the container 12 are completely consumed the container is conveniently removed from the cavity 29 within the housing 18 of the holder by deflecting the walls 20 and 22 outwardly so that the flanges 30 and 31 are moved beyond the sidewalls of the package for releasing the package from its inserted position within the housing 18. The spaces in the sidewalls 26 as defined by the slots 28 also provide access for gripping of the sides of the package 12 during the removal thereof. Thus, as the walls 20 and 22 are deflected, the sidewalls of the package that are exposed by the slots 28 are grasped and the package is pulled outwardly from the housing. Since the feeding member 44 is easily removed from the neck section 38, the housing 18 and the component parts of the feeding member are conveniently cleaned, for subsequent use.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A holder for a package containing a beverage, said package including a substantially rectangular upper wall having a hole therein adjacent one corner thereof and a penetrable membrane covering said hole, said holder comprising a housing having an interior cavity for receiving said package in a predetermined orientation therein and including a top wall having a perimeter, said housing top wall being in closely adjacent substantially aligned relation with said package upper wall when said package is received in said predetermined orientation in said cavity, tubular penetrating means depending from said housing top wall adjacent one corner thereof in substantially aligned relation with said hole when said package is received in said predetermined orientation in said cavity, said penetrating means having a central axis and being operative for penetrating said membrane as said package is assembled in said predetermined orientation and for passing said beverage outwardly from said package therethrough, and feeding means on said housing top wall communicating with said penetrating means for dispensing said beverage from said package, said feeding means including an enlarged tubular neck section on said housing top wall, said neck section having a central axis which is inwardly offset from the axis of said penetrating means in a direction toward a central location in said housing top wall and having a perimeter which is disposed entirely within the confines of the perimeter of said housing top wall.

2. A holder for a package containing a beverage, said package including a substantially rectangular top wall having a hole therein adjacent one corner thereof and a penetrable membrane covering said hole, said holder comprising a housing having an interior cavity for receiving said package in a predetermined orientation therein and including a top wall, said housing top wall being in closely adjacent substantially aligned relation with said package top wall when said package is received in said predetermined orientation in said cavity, tubular penetrating means depending from said housing top wall adjacent one corner thereof in substantially aligned relation with said hole when said package is received in said predetermined orientation in said cavity, said penetrating means having a central axis and being operative for penetrating said membrane as said package is assembled in said predetermined orientation and for passing said beverage outwardly from said package therethrough, and feeding means on said housing top wall communicating with said penetrating means for dispensing said beverage from said package to a user, said feeding means including a tubular neck section on said housing top wall, said neck section having a central axis which is inwardly offset from the axis of said penetrating means in a direction toward a central location on said top wall, and a feeding member being detachably received on said neck section and extending therefrom in inwardly offset relation with respect to the axis of said penetrating means and being sealingly received through the lips of a user for dispensing said beverage to said user.

* * * * *